US011930950B2

(12) United States Patent
Serrano Parra et al.

(10) Patent No.: US 11,930,950 B2
(45) Date of Patent: Mar. 19, 2024

(54) MULTIFUNCTION SHOEHORN

(71) Applicant: IMPROVING MOBILITY DEVELOPMENT SL, Alaquas (ES)

(72) Inventors: Francisco Serrano Parra, Alaquas (ES); Ignacio Manero Lojendio, Alaquas (ES)

(73) Assignee: IMPROVING MOBILITY DEVELOPMENT SL, Alaquas (ES)

( * ) Notice: Subject to any disclaimer, the term of this patent is extended or adjusted under 35 U.S.C. 154(b) by 0 days.

(21) Appl. No.: 17/659,937

(22) Filed: Apr. 20, 2022

(65) Prior Publication Data

US 2022/0338657 A1 Oct. 27, 2022

(30) Foreign Application Priority Data

Apr. 26, 2021 (ES) ..... ES202130364

(51) Int. Cl.
*A47G 25/90* (2006.01)

(52) U.S. Cl.
CPC ..... *A47G 25/905* (2013.01)

(58) Field of Classification Search
CPC .... A47G 25/905; A47G 25/90; A47G 25/908; A47G 25/00; A47G 25/80; A47G 25/82
USPC ..... D2/642
See application file for complete search history.

(56) References Cited

U.S. PATENT DOCUMENTS 3,692,217 A * 9/1972 Smith ..... A47G 25/905 223/111
4,284,216 A * 8/1981 Leland ..... A47G 25/905 223/111
4,765,520 A * 8/1988 Barton ..... A47G 25/905 223/111
6,234,369 B1 * 5/2001 Bort ..... A47G 25/905 223/111
6,942,129 B2 * 9/2005 Ferraioli ..... A47G 25/908 223/118
7,070,074 B2 * 7/2006 Landsberger ..... A47G 25/905 223/111
8,083,110 B2 * 12/2011 Wilkens ..... A47G 25/905 223/111
8,657,165 B1 2/2014 Liu
8,857,679 B2 * 10/2014 Skerman ..... A47G 25/908 223/111
2004/0149789 A1 8/2004 Landsberger et al.
2012/0061427 A1 * 3/2012 Ruf ..... A47G 25/908 223/112

FOREIGN PATENT DOCUMENTS

ES 1067245 U 5/2008
ES 2600009 T 2/2017
WO 2011085439 A1 7/2011

OTHER PUBLICATIONS

Search Report; Spanish Patent Office; dated Feb. 22, 2022.

* cited by examiner

*Primary Examiner* — Ismael Izaguirre

(57) ABSTRACT

Multifunction shoehorn comprising at least one base, and at least one central structure, characterized in that the central structure comprises at least one vertical or substantially vertical wall, U-shaped or substantially U-shaped, and with a first upper end and a second end lower, where the lower end is attached to the base; and the upper end comprises at least one groove or guide.

7 Claims, 4 Drawing Sheets

MULTIFUNCTION SHOEHORN

FIELD OF THE INVENTION

The present invention is framed within articles for domestic or personal use, more specifically to the personal devices used in relation with the use of clothing, and more specifically to the personal devices, such as shoehorns, used to facilitate the putting on or removal of compression stocking and/or socks.

BACKGROUND OF THE INVENTION

Currently, shoehorns are widely known, as elements used mainly in the domestic and personal sphere, which are designed to help the user to put on compression stockings and/or socks.

In general, this tools are comprised of static systems that cannot be adapted to the needs of the user, so that they are only configured to exclusively work with socks or compression stockings, so they cannot adapt their dimensions to the type of garment the user needs in each moment.

In this sense, we can find the document US2015190006 in which an improved device for putting on and taking off footwear is described, where the said device comprises a U-shaped sock support element, adapted to receive the user's foot, where inside the support element there is a double-sided adhesive layer, on which the sock is securely held.

Document JP2004230170 also belongs to the state of the art, in which an aid tool for the use of compression stockings is described, which is adapted to its use by a disabled person, or a person with reduced mobility. To do this, it comprises a base, at least one support for the stocking, and at least one handle.

Lastly, within the field of the shoehorns that cannot be adapted to the different types of socks and/or compressive stockings, we can find the document FR2785793, in which a stocking donning device is described, that comprises an horizontal base with a notch in the shape of a U, a support structure for the stockings, and two side handles.

Where the handles are connected to the base, and can pivot around a horizontal axis between an unhooked position, freeing up the space surrounding the support structure, and a vertical position, to achieve the placement of the stocking in the user's leg.

As can be seen, there are numerous documents in the state of the art, that are refer to domestic devices used to facilitate the placement of stockings of socks of specific sizes on the user's legs. However, these systems are not adaptable, so they would not be valid indistinctly for different mouthpieces sizes of the aforementioned garments.

To overcome this drawback, are also known different devices that are capable of adapting their operation to the different sizes of socks and/or stockings, so that they can be used regardless of the type of garment that the user wants to put on.

In this other sense, we can find document DE202008015999 in the state of the art, which describes a tool for putting on socks, stockings, compression stockings or support stockings, comprising a fastening device for the garment, with at least two folding jaws with their respective folding axes, and with at least one crank mechanism comprising at least one threaded spindle on each folding crank, so that the dimensions of the fastening of the garments can be enlarged or reduced, to adapt to the requirements of each situation.

Document WO2006032069 also belongs to the state of the art, in which a support for stockings is described, comprising a frame with an expansion device for two extensible jaws provided with a receptacle for the stockings and a self-locking spindle for activating the expansion mechanism. In the same way as in the previous document, an adaptability of the device to the different needs is sought, by means of the variation of its dimensions.

Finally, we can also find document DE20320601 in the state of the art, which describes an element to help put on compression stockings, comprising a mark that defines a cylindrical section with different cylindrical frames connected by a hinge, where the compression sock is placed over the tunnel section, and where the hinges help to expand the sock to aid insertion onto a wearer's foot. Also, the cylindrical section may comprise a lock to selectively hold it in a certain position.

As can be seen, the solutions to the problem of the adaptability of the shoe horns that the state of the art includes, go through the use of different mechanisms of greater or lesser complexity, which modify the dimensions of the handles or clamps that hold the garment to be placed.

In other words, these are dynamic systems that include movement mechanisms for the holding elements of the stocking and/or the sock, so that said mechanisms must be used to adapt the device to the eventual needs of the users.

From the generation of the solution to the problem of adaptability, the state of the art poses the inconvenience of simplifying the device, so that it can be used by any user, even with reduced mobility, without the need to perform complicated maneuvers.

That is why a static device is necessary, that is, without complex mechanisms, which allows the use of different dimensions of stockings and/or socks, so that the user does not have to actively modify the device itself according to the needs. of the. But you can use it in any circumstance without having to make previous modifications to the device.

SUMMARY OF THE INVENTION

The multifunction shoehorn that the invention proposes is configured, therefore, as a remarkable novelty within its field of application, since according to its implementation and in an exhaustive manner, the aforementioned objectives are satisfactorily achieved, with the characterizing details that make it possible and that conveniently distinguish them collected in the final claims that accompany this description.

The present invention proposes a shoehorn that allows its use independently of the size of the garment that the user wants to put on, and without the need to modify the dimension of one of the elements of the shoehorn, that is, without including complex mechanisms in the device itself, for which a solid body is proposed that does not see its structural integrity compromised in the face of the different tensions exerted by the garments.

Following this reasoning, the user will be able to use the shoehorn object of the present invention to put on both stockings and socks, whatever the diameter of their mouth, without needing to activate a mechanism, that allows the dimensions of the shoehorn to be adapted to the size of the garment To achieve this, the present invention comprises a horizontal base, a central structure, and at least two vertical elements located on the sides.

On the one hand, the horizontal base will serve as a support for the rest of the elements, maintaining their verticality, and serving as support for the correct use of the shoehorn by the user.

Likewise, the two vertical elements, located on the sides of the base, will serve as a handle or grip for users, so as to facilitate the placement and/or removal of the stocking and/or sock.

On the other hand, the central structure, configured as a support for the garment, will comprise at least one vertical wall in the shape of a U or similar, which will be joined to the base at its lower end, and which will comprise at least one slit or guide at its upper end.

In this way, the user will place the compression stockings in the entire perimeter of the U formed by the vertical wall, since, due to the larger diameter of the mouth of this type of garment, a larger size is needed in the support for the compression. own garment.

On the other hand, the user will place the socks on the perimeter that includes up to the slits or guides, allowing a smaller size of the support, adapted to the smaller diameter of the mouthpiece that socks generally have.

Although in the previous explanation, stockings and socks have been considered garments with a sufficiently different diameter to require two different support sizes, and notwithstanding the foregoing, both support systems will be used regardless of the type of garment, only taking into account the dimensions of the mouth of said garment.

In the same way, it is understood that the invention may comprise as many slits as desired, so that its use can be adapted to any garment size.

According to the previous description, the user would place the garment they wish to wear on the indicated support, depending on its size, and insert their foot inside the garment, passing it through the inside of the central U-shaped structure, pulling of the handles to achieve the correct placement of the garment on the user's leg. So that the support would be pulling the garment to achieve a tense and optimal position in the aforementioned extremity.

Likewise, the shoehorn may include a relief in the lower part of the central structure, so that the U-shaped section is only defined in the upper part, achieving a free space that the user can use to pass the ankle easily, improving the overall ergonomics.

In this way, a multifunction shoehorn is achieved that overcomes the drawbacks of the state of the art, by proposing a simplified solution to the problem of adaptability of shoehorns to different garments, since it does not require complex maneuvers to adapt the morphology of the device to the dimensions of the mentioned garments.

The multifunction shoehorn and the set of elements described represent an innovation with structural and constitutive characteristics unknown until now, reasons that, together with its practical utility, provide it with sufficient grounds to obtain the privilege of exclusivity that is requested.

BRIEF DESCRIPTION OF THE DRAWINGS

To complement the description that is being made and in order to help a better understanding of the characteristics of the invention, a set of drawings is attached as an integral part of said description, where for illustrative and non-limiting purposes, the following has been represented: Next.

LIST OF REFERENCES

Figure 1:
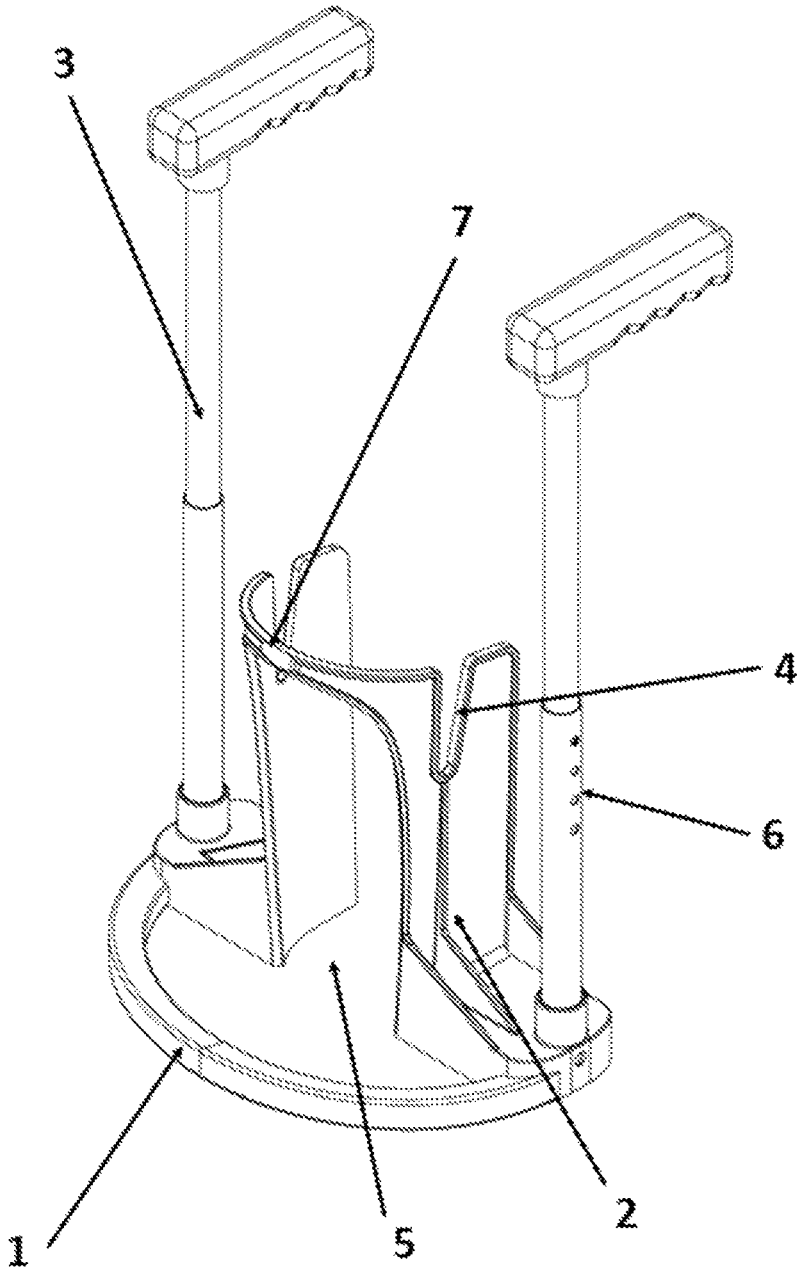
FIG. 1.—Shows a general view of the multifunction shoehorn
Figure 2:
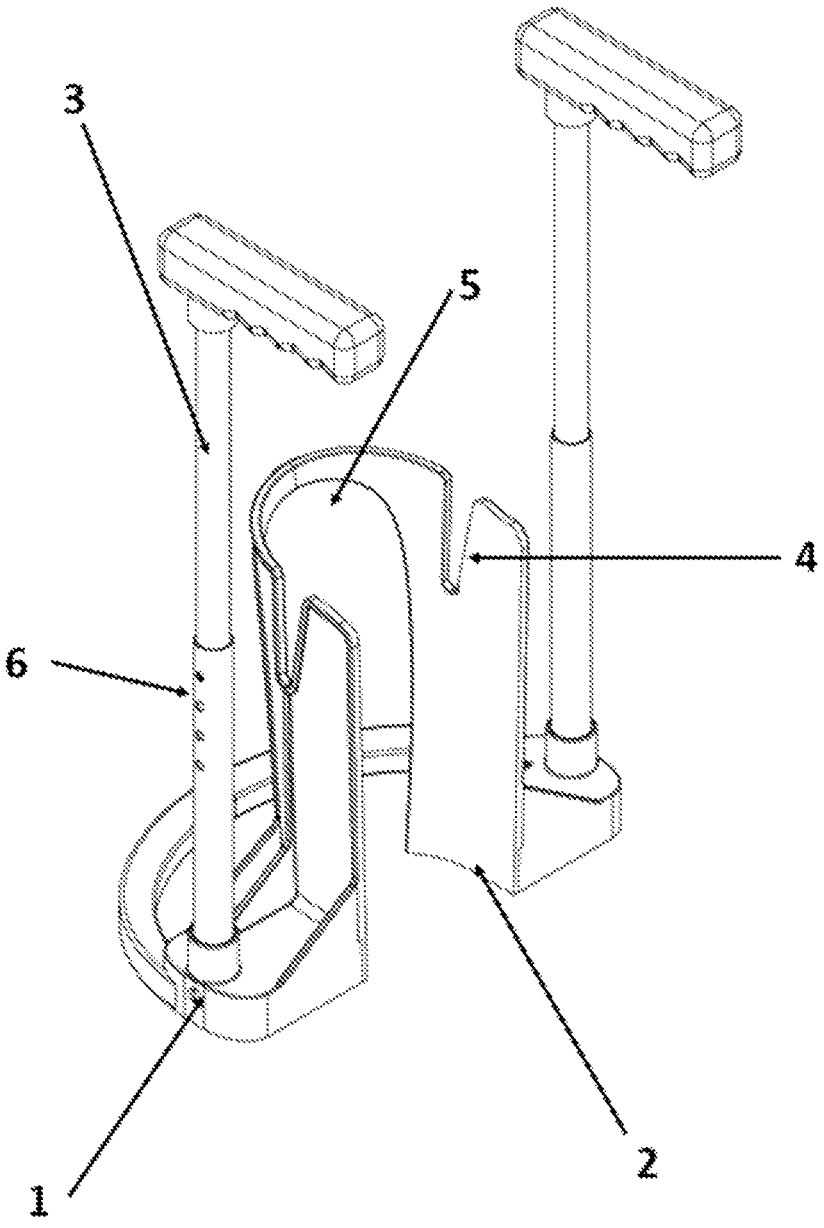
FIG. 2.—Shows another general view of the multifunction shoehorn.
Figure 3:
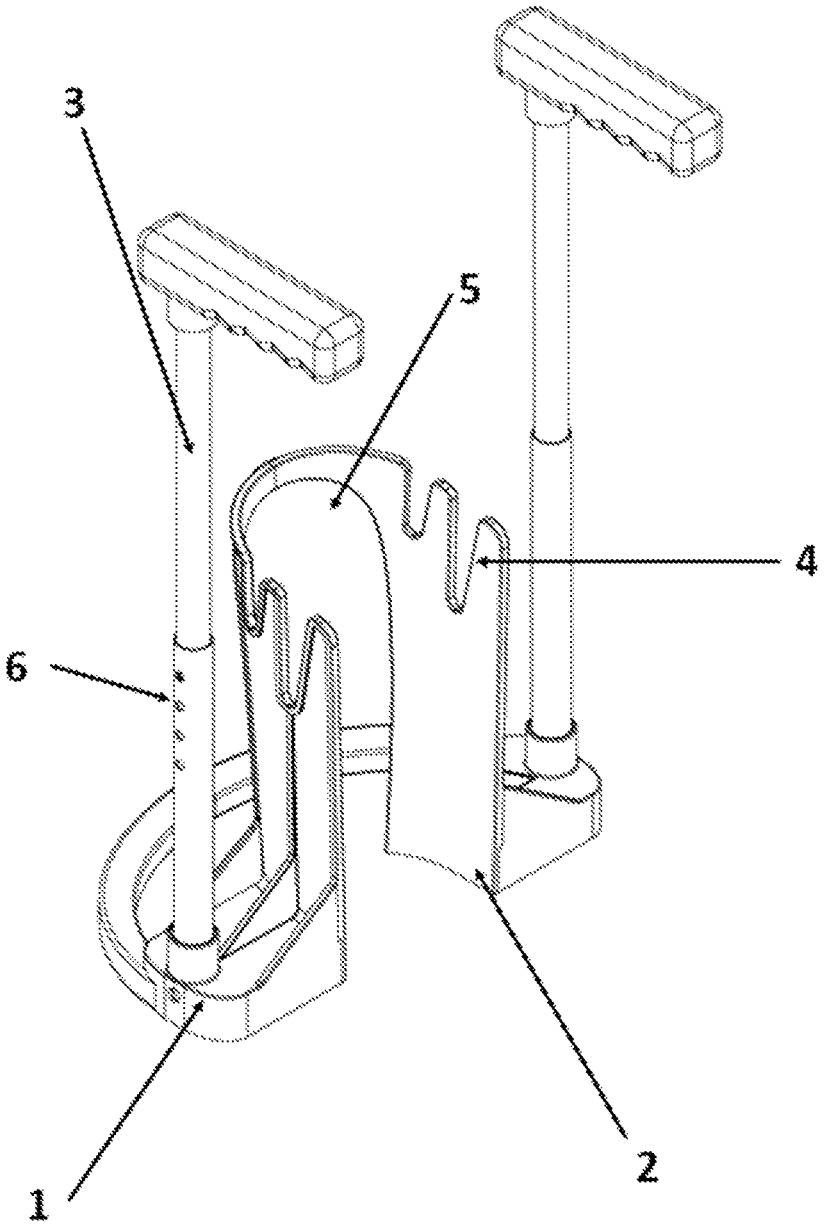
FIG. 3.—Shows an embodiment with various slots and/or guides.
Figure 4:
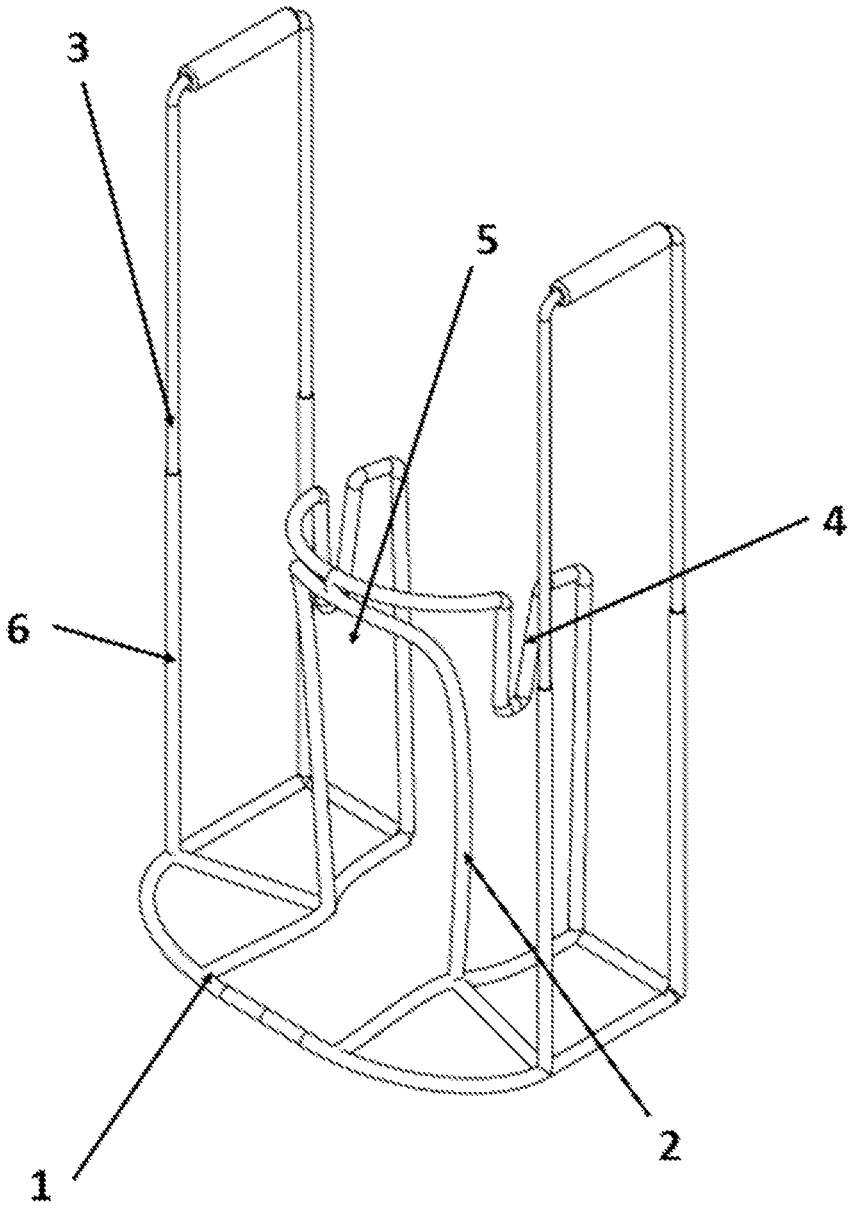
FIG. 4.—Shows the invention made with tubular profiles

1. Base
2. Central structure
3. Vertical element
4. Slit and/or guide
5. Relief
6. Height adjustment means
7. Projection

PREFERRED EMBODIMENT OF THE INVENTION

In the following detailed description of the preferred embodiments, reference is made to the accompanying drawings which form a part hereof, and in which there are shown by way of illustration specific preferred embodiments in which the invention may be practiced. These embodiments are described in sufficient detail to enable those skilled in the art to practice the invention, and it is understood that other embodiments may be used and logical structural, mechanical, electrical, and/or chemical changes may be made without departing from the scope of the invention. To avoid details not necessary to enable those skilled in the art to carry out the detailed description should therefore not be taken in a limiting sense.

Specifically, the present invention proposes a multifunction shoehorn comprising at least one base 1, with at least one central structure 2; which is characterized in that the central structure 2 comprises at least one vertical or substantially vertical wall, U-shaped or similar, and with a first upper end and a second lower end, where the lower end is joined to the base 1; and where the upper end comprises at least one slit or guide 4.

So that for larger diameter garments, the user uses the entire perimeter of the central structure 2; and for smaller diameter garments, the user uses the perimeter defined by the slits or guides 4 that comprise the vertical wall of the central structure 2.

In other words, a shoehorn is achieved that allows the placement of different garments regardless of their resistant characteristics, without the need to modify or adapt the morphology of the shoehorn itself to the requirements of the garments.

In a preferred embodiment, the shoehorn will comprise at least one handle as a vertical element 3, which will preferably comprise a handle-type element in its upper part. And that it may have projections forward and/or backward, so that the shoehorn can be turned towards the user, once it has been placed on the ground.

In a preferred embodiment of the above, the vertical elements 3 will comprise height adjustment means 6, so that they can be adapted to different users, while allowing the use of the device from different positions according to eventual needs.

In a preferred embodiment, the central structure 2 comprises a relief 5 and/or a recess in its lower part, so that only the U-shape defined in the upper part of the central structure 2 remains.

This relief 5 will be used so that the user can pass the heel without having any interference with the device itself, which facilitates its use and improves the ergonomics of the maneuver that the user must perform.

In another preferred embodiment, the central structure 2 comprises a projection 7 in its upper part, which facilitates the introduction of the garment in the first section of the U-shaped frame, avoiding the problems that the user may have due to the difficulty of overcoming the voltage generated by, for example, a stocking.

Preferably, the shoehorn will be made of a resistant material and/or with a tubular structure, so as to guarantee the complete integrity of the shoehorn during the garment donning operations.

Having sufficiently described the nature of the present invention, as well as the way of putting it into practice, it is not considered necessary to make its explanation more extensive so that any person skilled in the art understands its scope and the advantages derived from it, stating that, within its essentiality, it may be put into practice in other forms of embodiment that differ in detail from the one indicated by way of example, and to which it will also reach the protection that is sought as long as its fundamental principle is not altered, changed or modified.

The invention claimed is:

1. Multifunction shoehorn comprising at least one base (1), and at least one central structure (2), wherein the central structure (2) comprises at least one vertical or substantially vertical wall, U-shaped or substantially U-shaped, and with a first upper end and a second lower end, wherein the lower end is attached to the base (1) and wherein the upper end comprises at least one slit or guide (4) configured to allow the use of the shoehorn with garments of different sizes.

2. Multifunction shoehorn according to the first claim, characterized in that it comprises at least one vertical element (3) configured as a handle and/or handle.

3. Multifunctional shoehorn according to claim 2, characterized in that the vertical elements (3) comprise a handle-type element in their upper part.

4. Multifunctional shoehorn according to the first claim, characterized in that the central structure (2) comprises a relief (5) and/or a recess in its lower part.

5. Multifunction shoehorn according to the first claim, characterized in that the central structure (2) comprises a projection (7) in its upper part.

6. Multifunction shoehorn according to the first claim, characterized in that the vertical elements (3) comprise height adjustment means (6).

7. Multifunction shoehorn according to the first claim, characterized in that it is made of a resistant material and/or with a tubular structure.

* * * * *